United States Patent [19]

Cox

[11] 3,991,891

[45] Nov. 16, 1976

[54] COUNTERWEIGHT INSTALLATION MEANS FOR LOADERS AND THE LIKE

[75] Inventor: John A. Cox, Aubonne, Switzerland

[73] Assignee: Caterpillar Tractor Co., Peoria, Ill.

[22] Filed: Dec. 22, 1975

[21] Appl. No.: 643,422

[52] U.S. Cl. ..... 214/142; 212/49; 280/759

[51] Int. Cl.[2] ..... E02F 3/00

[58] Field of Search ..... 214/127, 131 A, 138 R, 214/142; 280/759, 760; 212/48, 49; 248/325, 364

[56] References Cited

UNITED STATES PATENTS

| | | | |
|---|---|---|---|
| 2,820,556 | 1/1958 | Davis | 214/142 |
| 2,967,718 | 1/1961 | Orwig | 280/759 |
| 3,003,785 | 10/1961 | Straszheim et al. | 280/759 |
| 3,511,692 | 6/1950 | Brown | 280/759 X |
| 3,533,524 | 10/1970 | Wilcox | 214/142 |
| 3,635,493 | 1/1972 | Barth et al. | 280/759 |
| 3,788,674 | 1/1974 | Casey | 214/138 R X |
| 3,795,330 | 3/1974 | Jorgensen et al. | 214/142 |

FOREIGN PATENTS OR APPLICATIONS

| | | |
|---|---|---|
| 1,396,684 | 6/1975 | United Kingdom |

*Primary Examiner*—L. J. Paperner

*Attorney, Agent, or Firm*—Wegner, Stellman, McCord, Wiles & Wood

[57] ABSTRACT

A counterweight system for use with an earthmoving apparatus adapted for selectively counterbalancing the front end of the drive machine thereof or the rear end of the drive machine thereof depending on whether or not an earthmoving structure is attached to the rear end. The rear end earthmoving structure may comprise a backhoe which is removably connected to the drive machine permitting the apparatus at times to function solely as a bulldozer or front loader apparatus. The counterweight system permits the counterweight to be installed on the front end earthmoving structure when the backhoe is in use thereon to counterbalance the backhoe. The counterweight system permits the counterweight to be installed on the rear end of the drive machine when the backhoe is removed therefrom so as to reversely counterbalance the apparatus when utilizing the same as a conventional front loader or bulldozer apparatus.

15 Claims, 11 Drawing Figures

COUNTERWEIGHT INSTALLATION MEANS FOR LOADERS AND THE LIKE

BACKGROUND OF THE INVENTION

1. Field of the Invention

This invention relates to earthmoving apparatus and in particular to means for counterbalancing earthmoving apparatus, such as loaders and the like.

2. Description of the Prior Art

In one conventional form of backhoe apparatus marketed by the assignee hereof, a crawler-type drive machine is provided at one end with a backhoe mechanism. The backhoe is removably attached to the drive machine by a mounting group assembly. The assembly includes mounting brackets carried on the rear end of the drive machine. Hydraulic lines with quick disconnect couplers are provided for operating the backhoe from the drive machine. Conventionally, a counterweight is provided adapted to be mounted on the front end of the drive machine when the machine travels with the backhoe attached.

One example of earthmoving apparatus utilizing removable counterweights is shown in U.S. Letters Pat. No. 2,820,556 of George Davis. Therein, a counterweight is provided for a truck means, or similar industrial vehicle, which is selectively removably installed on a crane-supporting platform thereof.

In U.S. letters Pat. No. 2,967,718 of Herbert L. Orwig, a removable counterweight is provided on a vehicle, such as a fork truck or other material handling machine. The counterweight is provided with lugs engaging frame members on the machine and suspending the counterweight below the frame members. The counterweight may be removed from the vehicle by moving it longitudinally of the frame members.

Robert D. Straszheim et al, in U.S. Letters Pat. No. 3,003,785, show a weight-mounting means for use with tractors and the like utilizing a plurality of identical weights adapted to be used singly or in multiples, as desired. The weights are mounted by means of fasteners insertable from the front so that each added weight is carried by the weight preceding it.

In U.S. Letters Pat. No. 3,533,524, John H. Wilcox discloses a counterweight removal arrangement for hydraulic excavators or the like wherein a counterweight is swingably mounted at the rear of the working frame by means of vertical suspension members so that it can be lowered and dismounted by lifting the front end of the machine. In one embodiment, the suspension members are extensible and retractable to enable the counterweight to be lowered slightly before the front end of the machine is elevated.

In U.S. Letters Pat. No. 3,788,674 of Robert Casey, owned by the assignee hereof, a clamping mechanism for a side shiftable backhoe is provided whereby the backhoe is supported at an infinite number of positions transverse to the axis of the vehicle. The counterweight system of the present invention is well adapted for use with such a backhoe apparatus and is illustrated in connection with its use thereon. Thus, reference may be had to U.S. Letters Pat. No. 3,788,674 for a detailed understanding of the earthmoving apparatus arrangement and for this purpose, said patent is incorporated by reference herein.

In British Pat. No. 1,396,684 of Klockner-Humboldt-Deutz Aktiengesellschaft, a boom is provided on a tractor or similar vehicle for raising and lowering a ballast weight so that the weight may be mounted on or removed from the vehicle. The ballast weight comprises individual weights and a base part secured together by a rod-shaped securing means with a crossbar comprising a pivot bearing disposed on each side of the weights.

SUMMARY OF THE INVENTION

The present invention comprehends an improved counterweight system for use in such earthmoving apparatuses which permits facilitated counterbalancing of the apparatus with and without one of the earthmoving structures attached thereto. In the illustrated embodiment, the apparatus comprises a backhoe apparatus similar to that of the above-discussed Casey U.S. Pat. No. 3,788,674, having a front end portion adapted to mount a bulldozer blade or loader bucket and a rear end portion adapted to removably carry a backhoe structure.

The counterbalancing system includes a counterweight adapted to be removably supported on either the bulldozer blade or loader bucket when the backhoe structure is mounted to the rear end of the drive machine so as to counterbalance the backhoe structure in normal use. The counterweight means is further adapted to be mounted on the rear end portion of the drive machine when the backhoe structure is removed therefrom so as to counterbalance the apparatus in the use of the bulldozer or loader bucket.

The invention comprehends an arrangement of the mounting means whereby the counterweight may be readily transferred and mounted to either the front or rear end portions of the drive machine. The counterweight mounting means is adapted to permit the bulldozer blade or bucket structure to removably carry the counterweight when the backhoe is installed. Upon removal of the backhoe from the drive machine, the drive machine may be suitably manipulated to transfer the counterweight to the rear end portion thereof by temporarily transferring the counterweight to the removed backhoe and subsequently effecting a transfer from the removed backhoe to the rear end portion of the drive machine. The removed backhoe may have a vertically adjustable mounting portion which may be adjusted with the counterweight temporarily carried thereon so as to suitably position the counterweight for facilitated mounting on mounting means carried by the rear end portion of the drive machine. The mounting means carried on the rear portion of the drive machine may comprise the mounting means for mounting the backhoe thereto, thereby minimizing the cost of the counterweight system.

As the counterweight may be readily transferred between the front and rear mounting positions solely by transferring operations effected by suitable operation of the drive machine, facilitated transfer of the counterweight to the different mounted arrangements is effected without the need for additional personnel solely by the operator of the earthmoving apparatus.

The mounting means may include bracket means on the counterweight adapted to removably engage support means on the front and rear end portions of the drive machine and on the backhoe.

The mounting bracket means of the counterweight adapted to provide the mounting of the counterweight to the front earthmoving structure in the illustrated embodiment, is utilized to mount the counterweight to the rear mounting structure and second mounting bracket means are provided for mounting the counterweight temporarily to the backhoe in the transfer operation as discussed above.

Thus, the counterweight system of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
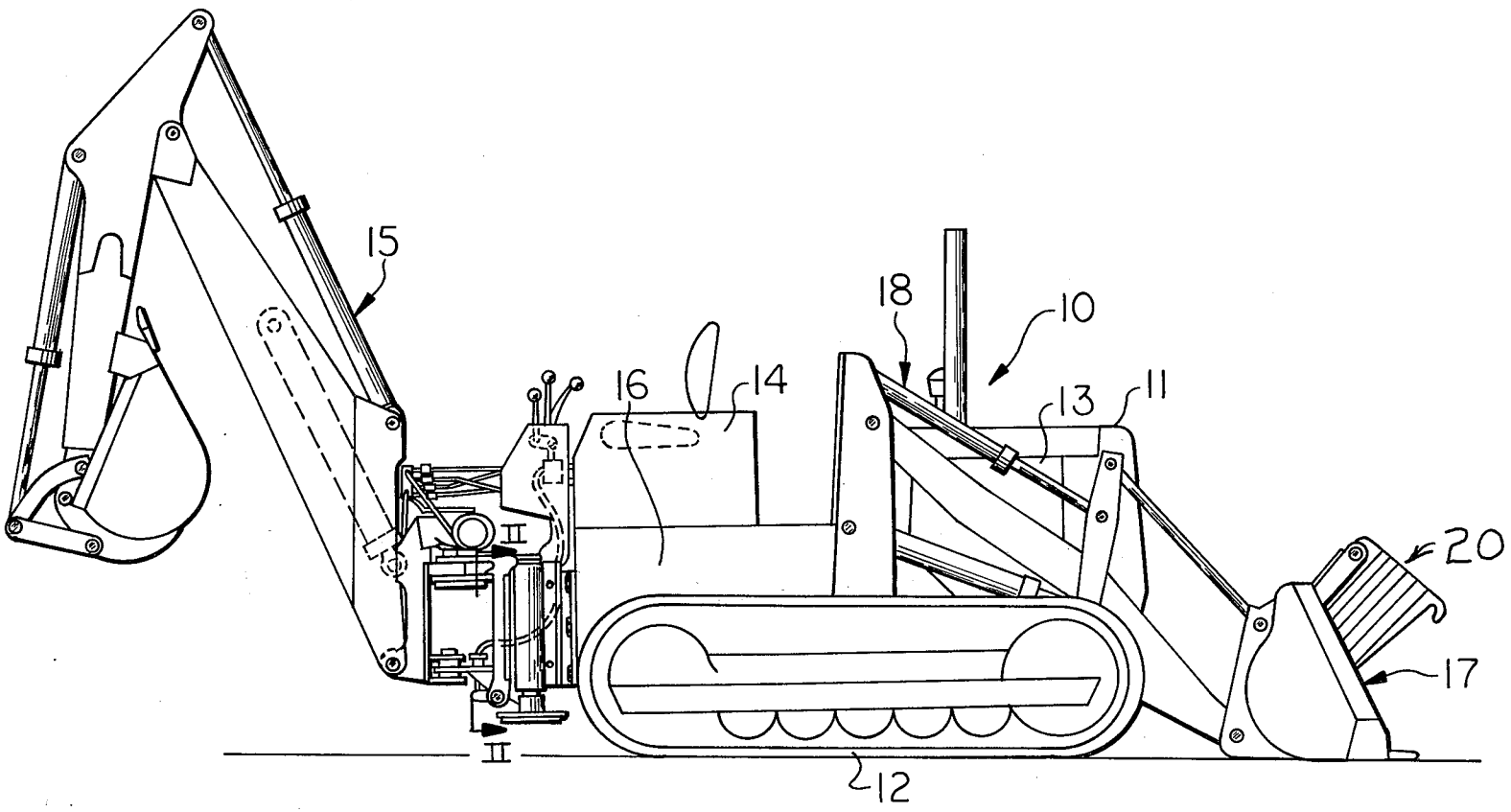
FIG. 1 is a side elevation of an earthmoving apparatus provided with a counterweight balancing system embodying the invention.
Figure 2:
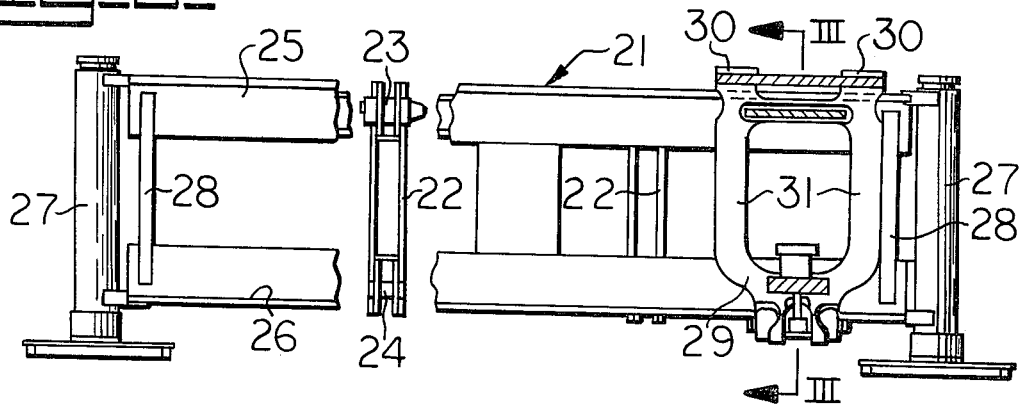
FIG. 2 is a fragmentary enlarged vertical section of the backhoe mounting means taken substantially along the line II—II of FIG. 1.

In the exemplary embodiment of the invention as disclosed in the drawing, an earthmoving apparatus generally designated 10 is shown to comprise a drive machine 11 provided with a conventional crawler 12 and suitable drive engine 13. Operation of the apparatus may be effected from a reversible driver's seat 14 which, as shown in FIG. 1, may face rearwardly for use of the apparatus as a backhoe apparatus with a backhoe earthmoving structure generally designated 15 mounted to the rear end portion 16 of the drive machine. With the backhoe removed from the drive machine, the drive machine is adapted to be used as a conventional loader utilizing a loader bucket generally designated 17 with the seat 14 reversed to provide forward operation of the apparatus.

Figure 9:
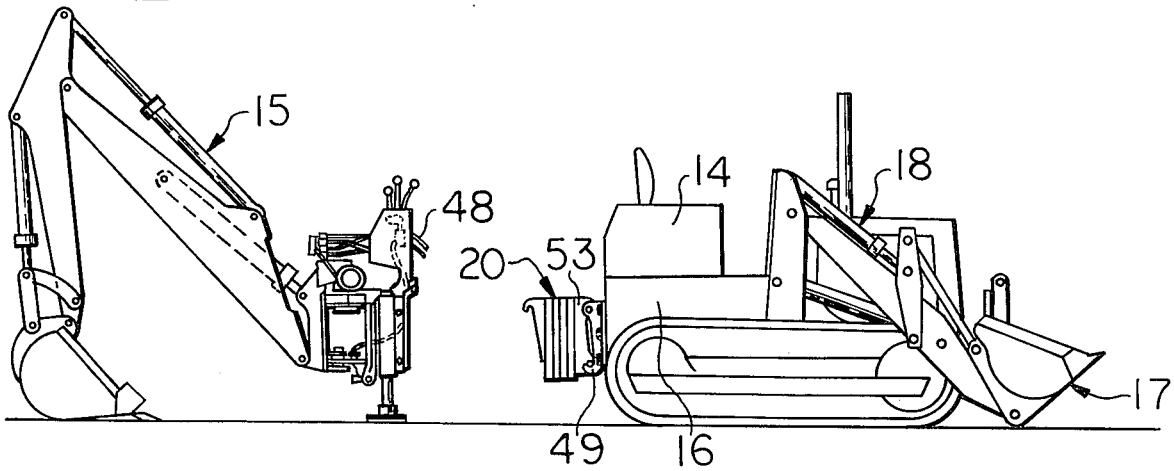
FIG. 9 is a side elevation illustrating a fifth step in the transfer operation wherein the counterweight is installed on the rear end portion of the drive machine for counterbalancing the apparatus with the backhoe disconnected therefrom.
Figure 11:
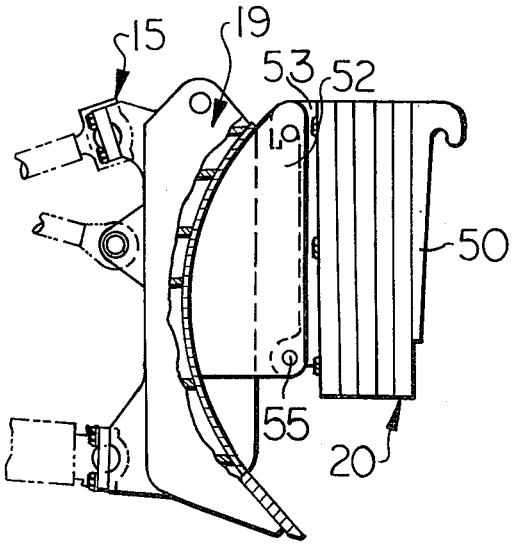
FIG. 11 is a side elevation partially in section illustrating the mounting of the counterweight on a front earthmoving structure comprising a bulldozer blade.

Conventional mechanism generally designated 18 may be provided for operating the bucket, as illustrated in FIG. 9. The apparatus may interchangeably be provided with a front earthmoving structure 19 comprising a bulldozer blade, as shown in FIG. 11.

Figure 7:
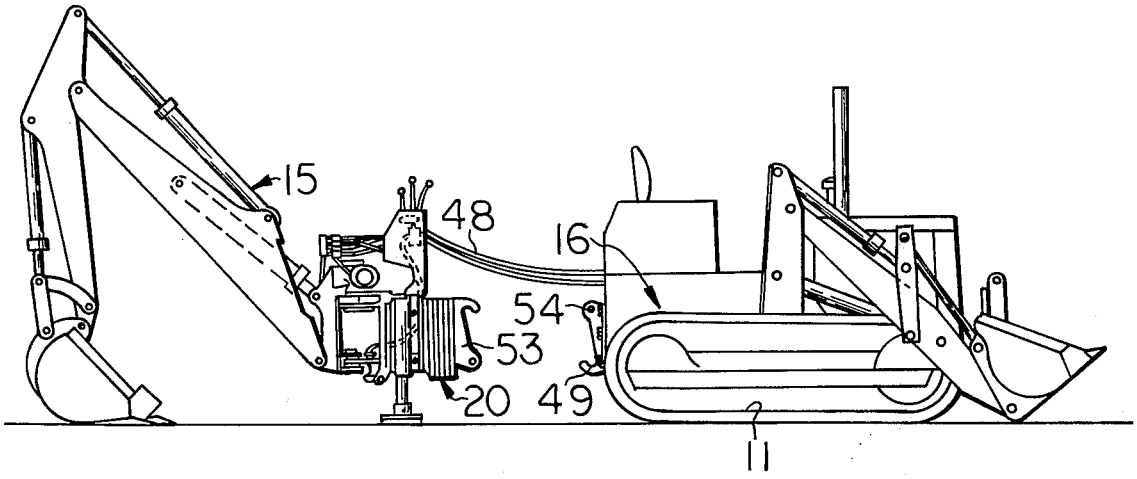
FIG. 7 is a side elevation illustrating a third step in the transfer operation.
Figure 8:
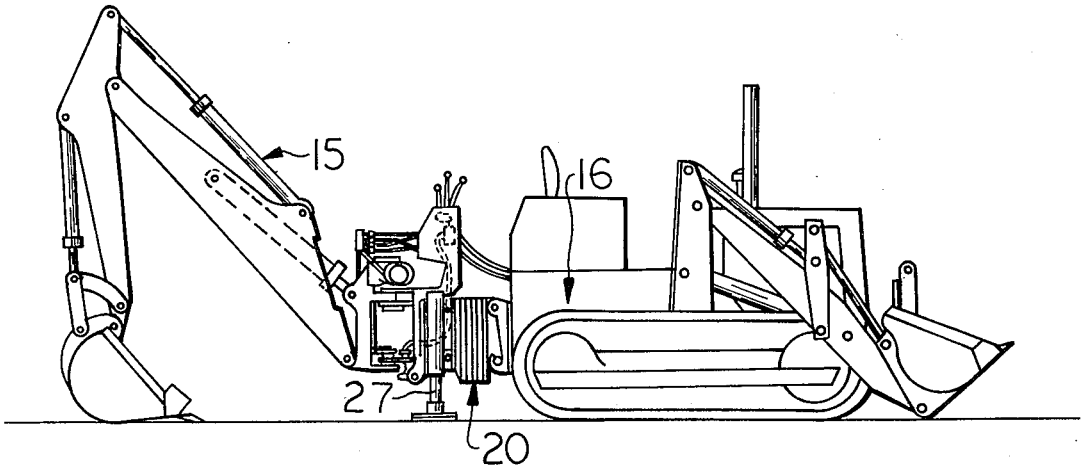
FIG. 8 is a side elevation illustrating a fourth step in the transfer operation.

The present invention is concerned with the provision of an improved system for effectively mounting a counterweight generally designated 20 selectively to the front earthmoving means of the apparatus, or to the rear end portion 16 of the apparatus. The counterweight system utilizes the backhoe 15 as a transfer structure in effecting a facilitated transfer between the two mounted positions. For this purpose, the backhoe is arranged to temporarily support the counterweight, as illustrated in FIGS. 7 and 8. The counterweight is transferred from the front earthmoving structure to the backhoe to provide the temporary support thereon and the drive machine is then reversed end-for-end to be transferred to the rear end portion 16 of the drive machine, as illustrated in FIGS. 8 and 9.

As the entire transferring operation may be effected by means of controlling the present structures of the earthmoving apparatus, the improved counterweight system provides facilitated selective mounting of the counterweight at minimum cost.

Backhoe 15 is provided with a base frame 21 detachably secured by upright support members 22 and pins 23 and 24 to the main frame of the drive machine, or tractor, 11.

Figure 3:
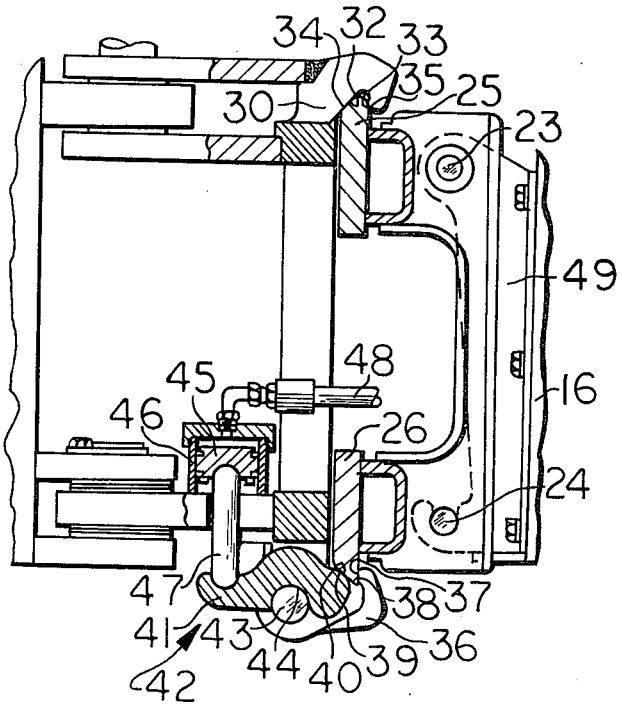
FIG. 3 is a fragmentary further enlarged vertical section thereof taken substantially along the line III—III of FIG. 2.

Backhoe frame 21 more specifically is mounted to an upper slide rail 25 and a lower slide rail 26 on the tractor frame. A pair of stabilizer jacks 27 is provided one each at the opposite ends of backhoe frame 21, and a pair of stops 28 is provided at the outer end of the slide rails 25 and 26 for controlling the movement of a slide frame 29 of the backhoe on the slide rails. The slide frame is supported on the upper slide rail 25 by bearing members 30 on upright support portions 31 of the slide frame. As shown in FIG. 3, the bearing members include upper surfaces 32 and 33 engaging complementary bearing surfaces 34 and 35 of the upper slide rail 25. The lower end of slide frame 29 is supported on lower slide rail 26 by means of hooks 36 having bearing surfaces 37 engaging complementary bearing surfaces 38 on rail 26.

Rail 26 further includes a downwardly directed bearing surface 29 engaged by a cam surface 40 on a lever 41 of a clamping mechanism generally designated 42. Lever 41 is pivotally mounted on a horizontal pin 43 by means of a semicylindrical bearing surface 44. A piston 45 is received in a cylinder 46 and connected by a link 47 to the lever 41. Fluid pressure is delivered to the piston cylinder through a supply line 48. Thus, the entire weight of the apparatus supported on the slide frame 29 assists in the clamping action.

Figure 4:
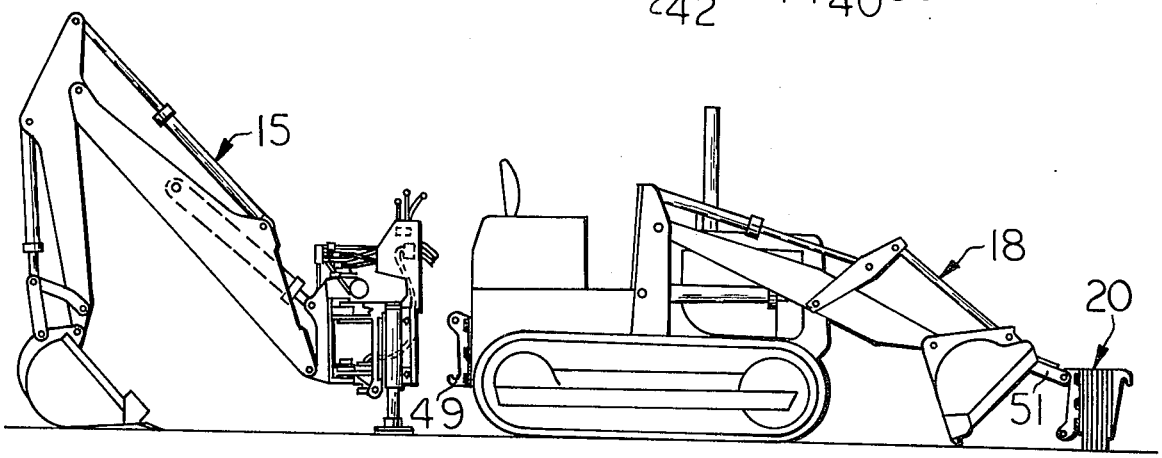
FIG. 4 is a side elevation of the apparatus illustrating a step in the transfer of the counterweight from the front earthmoving structure to the rear end portion of the drive machine.

When it is desired to remove the entire backhoe, including the main frame 21, the pins 23 and 24 may be removed permitting the removal of the entire assembly from a bracket 49 fixedly secured to the rear end portion 16 of the drive machine 11, as shown in FIG. 4.

Figure 6:
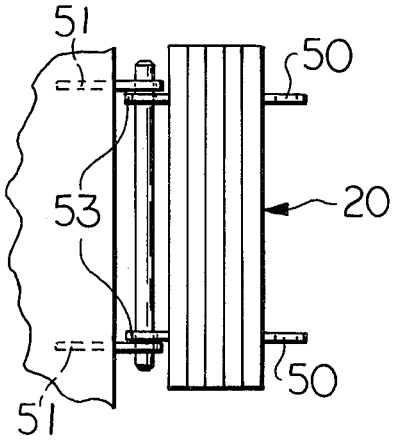
FIG. 6 is a top plan view of the counterweight installed on a rod support of the apparatus.
Figure 10:
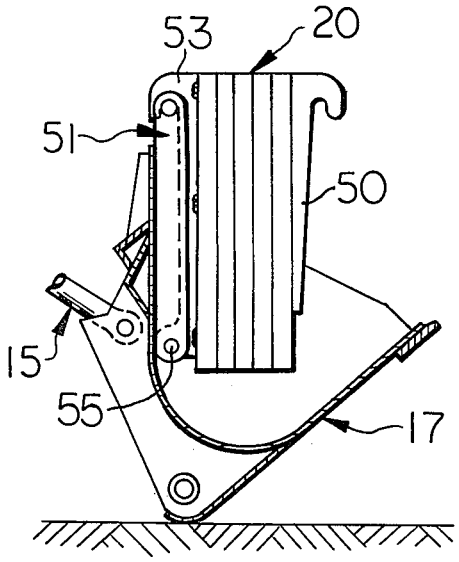
FIG. 10 is a side elevation illustrating the mounting of the counterweight on a front earthmoving structure comprising a loader bucket.

The improved counterweight means 20 may be normally mounted on the loader bucket 17 or bulldozer blade 19, as illustrated in FIGS. 10 and 11, when the backhoe is installed on the rear vehicle portion 16. Thus, as shown in FIG. 6, the counterweight includes a first pair of brackets 53 adapted to be removably mounted to suitable support 51 on bucket 17 and support 52 on bulldozer blade 19. The brackets 53 are further adapted for selective mounting on tractor bracket 49, as shown in FIG. 9. The counterweight may be locked against swinging when it is installed either on brackets 51, 52, or 49 by means of a pin 55 illustrated in FIG. 6 in connection with the mounting of the counterweight on the brackets 51 of the loader bucket. Pin 55 is removably received in suitable openings in each of the mounting brackets, as shown in FIG. 6, to lock the counterweight securely to the tractor permitting earth handling operation of the tractor with the tractor effectively balanced by the installed counterweight.

Figure 5:
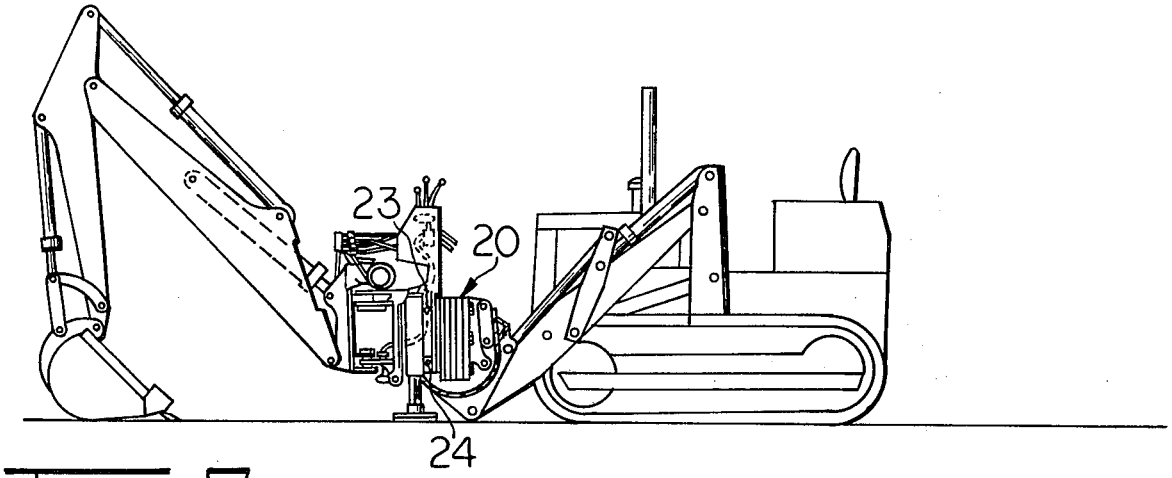
FIG. 5 is a side elevation illustrating a second step in the transfer operation.

When the earthmoving apparatus is intended for use without the backbone, it is desirable to transfer the counterweight 20 to the rear portion 16 of the vehicle for counterbalancing the vehicle in the use thereof with either the bucket or bulldozer blade. The counterbalancing system is adapted to effect this transfer in a novel and simple manner. More specifically, as shown in FIG. 4, upon removal of backhoe 15 from bracket 49, the counterweight may be suitably positioned by manipulation of the loader bucket mechanism 18 to permit the counterweight to be brought to the backhoe by suitable movement of the vehicle with the counterweight so carried. The counterweight brackets 53 are adapted to be mounted to the backhoe pins 23 and 24 with the backhoe freestanding on the ground, as shown in FIG. 5.

As shown in FIG. 7, drive machine 11 is then reversed end-for-end to bring rear portion 16 to adjacent the thusly supported counterweight 20. Fluid supply line 48 may be reattached to permit suitable adjustment of the vertical disposition of the counterweight relative to the cross rod 54 on bracket 49 of vehicle portion 16, permitting rearward movement of the vehicle to effect engagement of bracket 53 with the rod 54 and bracket 49 for transferring the counterweight from the backhoe to the drive machine 11. Support of the counterweight may then be released by the backhoe by retracting the stabilizer jacks 27, whereupon, as shown in FIG. 9, the drive machine may be moved away from the backhoe and used separately therefrom upon suitable disconnection of the supply line 48.

To reinstall the counterweight on either the bucket 17 or bulldozer blade 19 when the drive machine is again used with the backhoe apparatus 15, a reverse of the above-discussed procedure is effected.

As best seen in FIG. 4, counterweight brackets 50 permit a swinging of the counterweight on the support 51 in effecting the desired transfer. In the normal use of the apparatus with the backhoe, the bucket 17 or bulldozer blade 19 may be suitably raised to bring the counterweight to a limit position wherein the weight of the counterweight is supported by the bracket means 51 or 52 to prevent such swinging in the earthmoving operation.

Thus, the present invention comprehends an improved counterweight system wherein a single counterweight may be utilized with different types of earthmoving structures conventionally mounted to the forward portion of a drive machine, such as a crawler tractor. The counterweight is adapted to be readily transferred to a rear portion of the drive machine when desired by use of a portion of the backhoe, when the backhoe is removed from the drive machine, as a temporary support of the counterweight during the transfer operation. The means for mounting the counterweight to the rear portion of the drive machine may comprise the same means as utilized for mounting the backhoe thereto, thus further simplifying and minimizing the cost of the apparatus.

The foregoing disclosure of specific embodiments is illustrative of the broad inventive concepts comprehended by the invention.

I claim:

1. In an earthmoving apparatus having a drive machine, a first earthmoving structure mounted to an end of the drive machine, a second earthmoving structure, mounting structure on the opposite end of the drive machine for removably mounting the second earthmoving structure to said opposite end of the drive machine, and a counterweight for counterbalancing the apparatus, improved counterweight mounting means comprising means for selectively mounting the counterweight to the first earthmoving structure, the second earthmoving structure, and said mounting structure.

2. The earthmoving apparatus of claim 1 wherein said second earthmoving structure comprises a backhoe.

3. The earthmoving apparatus of claim 1 including means for adjustably positioning the second earthmoving structure subsequent to its removal from said mounting structure to adjustably dispose the counterweight for mounting engagement by said mounting structure.

4. The earthmoving apparatus of claim 1 wherein said counterweight mounting means includes a first bracket on said counterweight adapted to be selectively removably mounted to said first earthmoving structure and said mounting structure.

5. The earthmoving apparatus of claim 1 wherein said counterweight mounting means includes a first bracket on said counterweight adapted to be selectively removably mounted to said first earthmoving structure and said mounting structure and a second bracket adapted to be removably mounted to said second earthmoving structure.

6. The earthmoving apparatus of claim 1 wherein said counterweight mounting means includes a first bracket on said counterweight adapted to be selectively removably mounted to said first earthmoving structure and said mounting structure and a second bracket adapted to be removably mounted to said second earthmoving structure, said first bracket being disposed at a first side of said counterweight and said second bracket being disposed at a second side of said counterweight opposite said first side.

7. The earthmoving apparatus of claim 1 wherein said first earthmoving structure comprises a bulldozer blade structure, said counterweight mounting portion including means fixedly secured to said blade structure.

8. The earthmoving apparatus of claim 1 wherein said first earthmoving structure comprises a bucket structure, said counterweight mounting portion including means fixedly secured to said bucket structure.

9. The earthmoving apparatus of claim 1 wherein said counterweight mounting means includes a first portion fixedly secured to said first earthmoving structure and means on said counterweight selectively engageable therewith.

10. The earthmoving apparatus of claim 1 wherein said counterweight is provided with means defining a stop shoulder for engaging said first earthmoving structure to position the counterweight thereon in a preselected mounted position.

11. In a loader apparatus having a drive machine, a first earthmoving structure vertically adjustably mounted to one each of the drive machine means, a backhoe including a vertically adjustable mounting portion, mounting structure on the opposite end of the drive machine for removably mounting the backhoe mounting portion to said opposite end of the drive machine, and a counterweight for counterbalancing the apparatus, improved counterweight mounting means comprising:

support means on said first earthmoving structure, said backhoe, and said opposite end of the drive machine; and bracket means carried by the counterweight for selectively mounting the counterweight to said support means of the first earthmoving structure, the backhoe mounting portion with the backhoe removed from the drive machine, or said mounting structure.

12. The loader apparatus of claim 11 wherein means are provided for adjusting the vertical disposition of the backhoe mounting portion from the drive machine subsequent to removal of the backhoe from the drive machine thereby to adjust the vertical disposition of the counterweight when mounted on said backhoe mounting portion.

13. The loader apparatus of claim 11 wherein said first earthmoving structure comprises a bulldozer blade.

14. The loader apparatus of claim 11 wherein said first earthmoving structure comprises a bucket.

15. The loader apparatus of claim 11 wherein said counterweight is mounted to said first earthmoving structure substantially at all times when the backhoe is mounted to the drive machine, and is mounted to the drive machine substantially at all times when the backhoe is removed from the drive machine.

* * * * *